US006770114B2

(12) United States Patent
Bartone et al.

(10) Patent No.: US 6,770,114 B2
(45) Date of Patent: Aug. 3, 2004

(54) DENSIFIED SINTERED POWDER AND METHOD

(75) Inventors: Kenneth J. Bartone, Mahwah, NJ (US); Santosh K. Das, Randolph, NJ (US)

(73) Assignee: Honeywell International Inc., Morristown, NJ (US)

( * ) Notice: Subject to any disclaimer, the term of this patent is extended or adjusted under 35 U.S.C. 154(b) by 96 days.

(21) Appl. No.: 10/024,729

(22) Filed: Dec. 19, 2001

(65) Prior Publication Data

US 2003/0110887 A1 Jun. 19, 2003

(51) Int. Cl.[7] ..... B22F 1/00
(52) U.S. Cl. ..... 75/255; 75/245; 75/246
(58) Field of Search ..... 75/255, 246, 245

(56) References Cited

U.S. PATENT DOCUMENTS

| | | | | |
|---|---|---|---|---|
| 2,373,405 A | | 4/1945 | Lowit | |
| 2,478,420 A | * | 8/1949 | Payson | 420/105 |
| 3,325,277 A | * | 6/1967 | Hyseby | 419/29 |
| 3,725,142 A | * | 4/1973 | Huseby | 419/12 |
| 3,864,809 A | * | 2/1975 | Donachie | |
| 3,992,202 A | | 11/1976 | Dulis et al. | |
| 4,049,429 A | * | 9/1977 | Donachie | 75/246 |
| 4,448,746 A | * | 5/1984 | Kubo et al. | 148/500 |
| 4,470,953 A | | 9/1984 | Bruce | |
| 4,591,470 A | | 5/1986 | Goto et al. | |
| 4,595,556 A | | 6/1986 | Umeha et al. | |
| 4,613,369 A | | 9/1986 | Koehler | |
| 4,614,630 A | | 9/1986 | Pluim, Jr. | |
| 4,616,389 A | | 10/1986 | Slee | |
| 4,643,648 A | | 2/1987 | Hüller | |
| 4,649,037 A | | 3/1987 | Marsh et al. | |
| 4,704,079 A | | 11/1987 | Pluim, Jr. | |
| 4,729,789 A | | 3/1988 | Ide et al. | |
| 4,743,237 A | | 5/1988 | Sweere | |
| 4,777,002 A | | 10/1988 | Pütz | |
| 4,834,938 A | | 5/1989 | Pyzik et al. | |
| 4,845,056 A | | 7/1989 | Yamanis | |
| 4,847,962 A | | 7/1989 | Puetz | |
| 4,857,411 A | | 8/1989 | Yamaguchi et al. | |
| 4,969,262 A | | 11/1990 | Hiraoka et al. | |
| 5,013,611 A | | 5/1991 | Suzuki et al. | |
| 5,032,555 A | | 7/1991 | Yamanis et al. | |
| 5,087,595 A | | 2/1992 | Marsh et al. | |
| 5,100,847 A | | 3/1992 | Li et al. | |
| 5,250,251 A | | 10/1993 | Fanelli et al. | |
| 5,273,710 A | | 12/1993 | Zengin | |
| 5,286,767 A | | 2/1994 | Rohrbach et al. | |
| 5,312,788 A | | 5/1994 | Li et al. | |
| 5,328,657 A | | 7/1994 | Kamel et al. | |
| 5,338,508 A | * | 8/1994 | Nitta et al. | 420/120 |
| 5,397,520 A | | 3/1995 | Rohrbach et al. | |
| 5,531,958 A | | 7/1996 | Krueger | |
| 5,574,959 A | | 11/1996 | Tsujioka et al. | |
| 5,682,665 A | | 11/1997 | Svanberg | |
| 5,710,969 A | | 1/1998 | Newman | |
| 5,744,173 A | | 4/1998 | Sterett | |
| 5,746,957 A | | 5/1998 | Fanelli et al. | |
| 5,770,136 A | | 6/1998 | Huang | |
| 5,782,954 A | * | 7/1998 | Luk | 419/19 |
| 5,948,996 A | | 9/1999 | Takeuchi et al. | |
| 5,958,314 A | | 9/1999 | Draenert | |
| 5,963,771 A | | 10/1999 | Chan et al. | |
| 5,989,493 A | | 11/1999 | La Salle et al. | |
| 6,033,788 A | | 3/2000 | Cawley et al. | |
| 6,056,915 A | | 5/2000 | Behi et al. | |
| 6,126,873 A | | 10/2000 | Zedalis et al. | |
| 6,126,894 A | | 10/2000 | Moxson | |
| 6,143,240 A | | 11/2000 | Jones et al. | |
| 6,268,412 B1 | | 7/2001 | Zedalis et al. | |

FOREIGN PATENT DOCUMENTS

| | | |
|---|---|---|
| JP | 402254104 A | 10/1990 |
| JP | 404218605 A | 8/1992 |
| JP | 405319938 A | 12/1993 |
| JP | 405320711 A | 12/1993 |

OTHER PUBLICATIONS

Thomas P. Marshall, "Injection Molding of 17–4 PH Stainless Steel", SAE Technical Paper Series; Reprinted from SP–597 Advanced Aerospace Materials Technology, Aerospace Congress & Exphosition, Long Beach, California, Oct. 15–18, 1984.

* cited by examiner

*Primary Examiner*—Ngoclan Mai
(74) *Attorney, Agent, or Firm*—Robert Desmond, Esq.

(57) ABSTRACT

A powder for metal injection molding of has a silicon content of less than 0.1%. Silica inclusions are substantially eliminated in the finished molded product.

10 Claims, 5 Drawing Sheets

| Micron | Cum % Pass |
|---|---|
| 176.0 | 100.0 |
| 125.0 | 100.0 |
| 88.0 | 100.0 |
| 62.0 | 100.0 |
| 44.0 | 98.7 |
| 31.0 | 97.6 |
| 22.0 | 91.0 |
| 16.0 | 71.1 |
| 11.0 | 47.2 |
| 7.8 | 28.7 |
| 5.5 | 16.1 |
| 3.9 | 6.3 |
| 2.8 | 1.5 |
| 1.9 | 0.0 |
| Percentile Ranks | |
| %10 | 4.50 |
| %50 | 11.58 |
| %90 | 21.69 |

FIG. 1

DENSIFIED SINTERED POWDER AND METHOD

BACKGROUND OF THE INVENTION

1. Field of the Invention

The present invention relates generally to a metallic powder for sintering and to sintered metallic powder as well as to a method therefor.

2. Description of the Related Art

Metal injection molding (MIM) is a process for forming metal parts by injecting fine metal powders mixed with a binder into molds similar to those used in conventional plastic injection molding. After molding, the MIM part is debound, in other words, the binder is removed, and the part is sintered, for example at temperatures of 2,200° F. or higher, to fuse the fine powdered particles into a solid shape that retains all of the mold's features.

Specifically, metal powders are mixed with thermoplastic binders or other binders to form a homogeneous mixture, with approximately 60% volume metal powder and 40% volume plastic. This mixture (referred to as "feedstock") is first heated until it is able to flow, is then injected under relatively low pressure into a mold cavity, and allowed to cool and solidify and finally is ejected as an intricately shaped part. The part is thus molded at relatively low temperatures and pressures in conventional plastic injection molding machines. The molds are similar to those used in plastic injection molding, with slides and multi-cavity configurations possible. The molded "green parts" are then thermally processed in two steps. First, the binder is removed by evaporation in an operation called debinding. Alternately, the green part is immersed in a bath to dissolve a majority of the binder and then the part is exposed to ultraviolet light to harden the thermosetting component of the binder. Next, the part is sintered (i.e., heated to a temperature near the alloy melting point) in, for example, a dry hydrogen atmosphere, which densifies the part isotropically. The complex shape of the original molded part is retained throughout this process, and close tolerances can be achieved. Only minor, if any, machining is required as a secondary operation.

Metal injection molding may use a variety of alloys and metals, including stainless steels, soft magnetic alloys, controlled expansion alloys and low alloy steels. Specifically, the MIM process allows for a wide selection of metal alloys, including: stainless steel (including 304, 316, 410, 420, and 17-4PH), copper, alloy steels, molybdenum, tool steels, tungsten, and specialty alloys such as ASTM F15 (Kovar), and ASTM F75 (CoCr "nickel-free").

One example of a stainless steel alloy in use is designated 17-4PH. This material has, for example, the following weight percents of material: Cr=16.5%, Ni=4%, Cu=4%, Cb+Ta=0.3%, C=0.03% max, and Fe for the balance. The 17-4PH alloy delivers the corrosion resistance of a type 304 steel, yet is as strong as type 420 martensitic stainless.

Metal injection molding has been used in the following industries: medical, aerospace, ordnance, automotive, dental/orthodontic, electrical, hardware, and consumer products.

The metal powder for the metal injection molding process is formed by spraying. Specifically, the molten metal is forced through a nozzle to form small droplets. The metal alone results in droplets of a size which is too large to serve as an injection molding powder and so silicon is added to about 1% to the melted metal to aid the flow of the liquid metal through the nozzle and form smaller droplets. These small droplets cool to form the metal powder used for the metal injection molding.

SUMMARY OF THE INVENTION

The present invention in one aspect provides a metal injection molding feedstock having improved properties, in particular, a metal injection molding feedstock powder having a reduced amount of silicon. The invention in another aspect also provides a metal injection molded part having little or no agglomerated silica. The invention in yet another aspect also relates to a method for forming powdered metal for metal injection molding by reducing the quantity of silicon.

BRIEF DESCRIPTION OF THE DRAWINGS

FIG. 1 is a table of particles sizes for a sintering powder for metal injection molding according to the present invention;

DETAILED DESCRIPTION OF THE PREFERRED EMBODIMENTS

Figure 2:
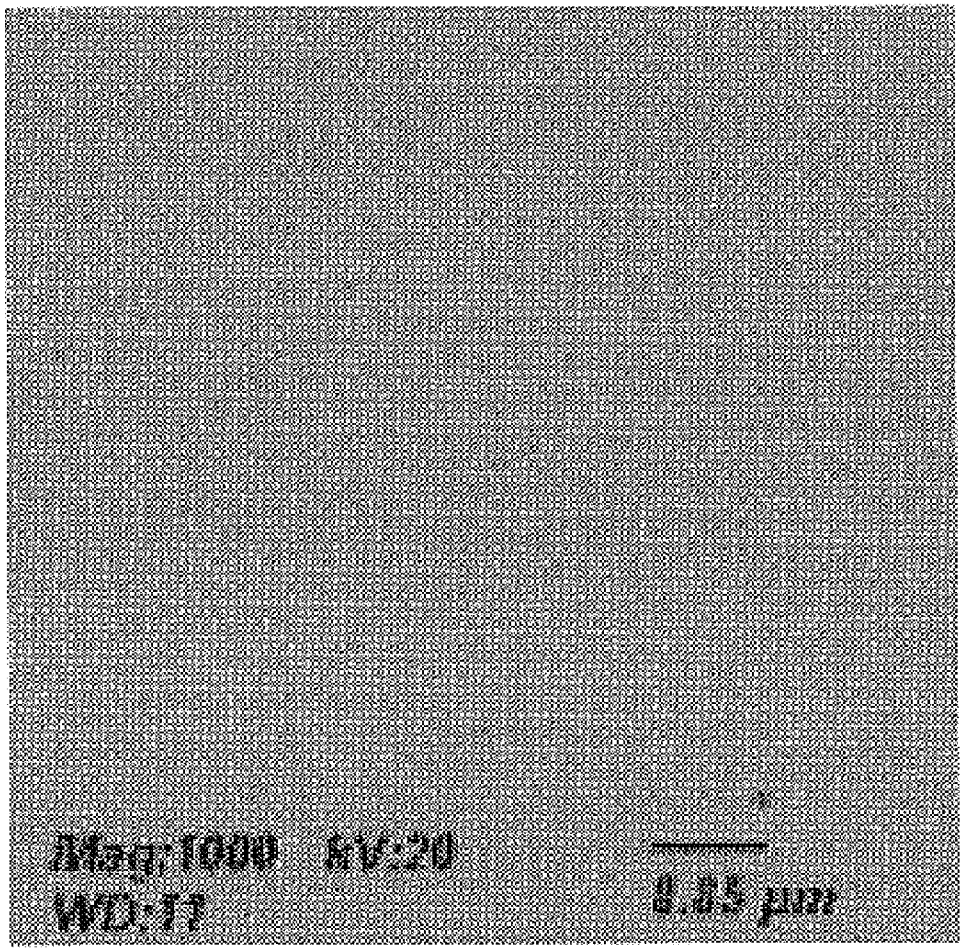
FIG. 2 is a scanning electron microscope micrograph of a molded component formed of a 17-4PH steel material having less than 0.05% silicon according to the present invention.

The following is a description of the preferred embodiments of the invention which are not intended to limit the scope of the patent protection warranted hereon, but to promote an understanding of the invention by description of preferred embodiments.

Metal injection molding utilizes an ultrafine metal powder during the molding process. The metal powder for metal injection molding is prepared by melting the metal or metal alloy to be used and then forcing the liquid material through a nozzle to form droplets. If only the metal is forced through the nozzle, the droplets are of a large size which is inappropriate for metal injection molding. Thus, silicon is added to the melted metal or metal alloy; the silicon aids the flow of the liquid through the nozzle to enable smaller droplets to form which cool and result in a powder.

According to the present invention, the silicon is added to a quantity of less than 0.1% by volume to the metal or metal alloy prior to ejecting the material through the nozzle. This results in a powder with a particle diameter appropriate for metal injection molding. Otherwise, the powder is prepared just as is known, including at the same pressure and temperature and with the same nozzle. In one example, silicon is added to 17-4PH steel to a quantity of 0.05% by volume and resulted in a particle diameter of less than 22 microns for 90% of the particles with the particles averaging about 8 microns in diameter. The particles were tested using a Leeds Northrup Microtrac, Model 7997 standard range analyzer, resulting in the particle size distribution shown in the table of FIG. 1. A cumulative pass analysis of the sample finds the cumulative pass percent laid out in the Figure.

This compares favorably to the standard process for forming 17-4PH steel particles, wherein silicon is added to a quantity of 0.5 to 1%. One sample with a silicon content of 0.57% produced a particle size of about 15 microns. Specifically, the 90% particles size in the cumulative pass analysis is 15.72 microns, with an average particle size of 8.51 microns.

A variety of different metals may be used instead of the 17-4PH steel material of the example, such as other steels, metals or metal alloys. For example, stainless steels, low carbon steel, tool steel, soft magnetics, high nickel superalloys, or titanium may be used. Any material in which the silica agglomerates occur may benefit from the present invention.

The metal injection molding process begins with the powder produced according to the present invention as the main component of the injection feedstock. The metal powder is mixed with a binder to form the feedstock, it is injected into a mold, heated to form the molded part, removed from the mold and treated to remove the binding agent. This may be by heating or a bath to dissolve the binder. The molded part is then heated in a furnace to sinter the powder into a solid.

More specifically, the binder used in a preferred molding step is water based agar that is added at 17% to the 17-4PH powder and which services as the vehicle for the injection into the mold. An antibacterial agent is included to prevent the growth of bacteria in the mixture. A variety of different binders are possible. The binder for the feedstock may be a plastic, a wax or agar, for example.

In a sintering cycle, which is a solid phase sintering, for a part molded from the 17-4PH material the molded part is dried in air for 1 hour at 110° C., and then is subjected to a debinding process for 2 hours at 270° C. Since the air oxidizes the particles of the metal, a reduction step is performed for 1 hour at 1010° C. in an atmosphere of 600 torr. of hydrogen. This reduces the metal oxides in the molded part. The time required for each step of the process depends in part on the thickness and total mass of the parts in the furnace.

The silicon also oxidizes to form silica. However, reduction of silica would require a significantly higher temperature and a lower dew point of hydrogen than is required for reduction of the metal oxides and is thus not economical.

The densification step for the molded part in the present sintering cycle is at 1350° C. for 20 minutes in an atmosphere of 600 torr. of hydrogen. Next an HIP step is performed at 15 KSI argon at 2050° F. and a heat treatment is performed, including for example a quench to form martensite steel.

Use of the standard grade 17-4PH powder with silicon added to about 0.5 to 1% results in silica inclusions in the finished part. These inclusions, which are formed by the silicates that form during the sintering process, are of irregular shapes and are randomly distributed in the material. As a result, the inclusions may agglomerate into larger inclusions. During fatigue testing of the parts, the inclusions have been found to be a site of most fatigue failures.

While the standard grade of 17-4PH powder has a maximum silicon content for gas atomization of 1.0 to 0.7%, with typical a typical value of 0.5%, the present invention provides a 17-4PH powder of 0.1%. In a preferred embodiment, the 17-4PH powder has a silicon content of 0.05% or less.

The molded parts manufactured according to the present invention have been subjected to inspection and testing. The silicate inclusions were not formed in the molded parts. See FIG. 2 wherein no discernable inclusions are seen in the micrograph of a part molded from 17-4PH having less than 0.05% silica. No silica was seen in the SEM microphotographs of the parts. The parts have a density of greater than 99%.

Figure 3:
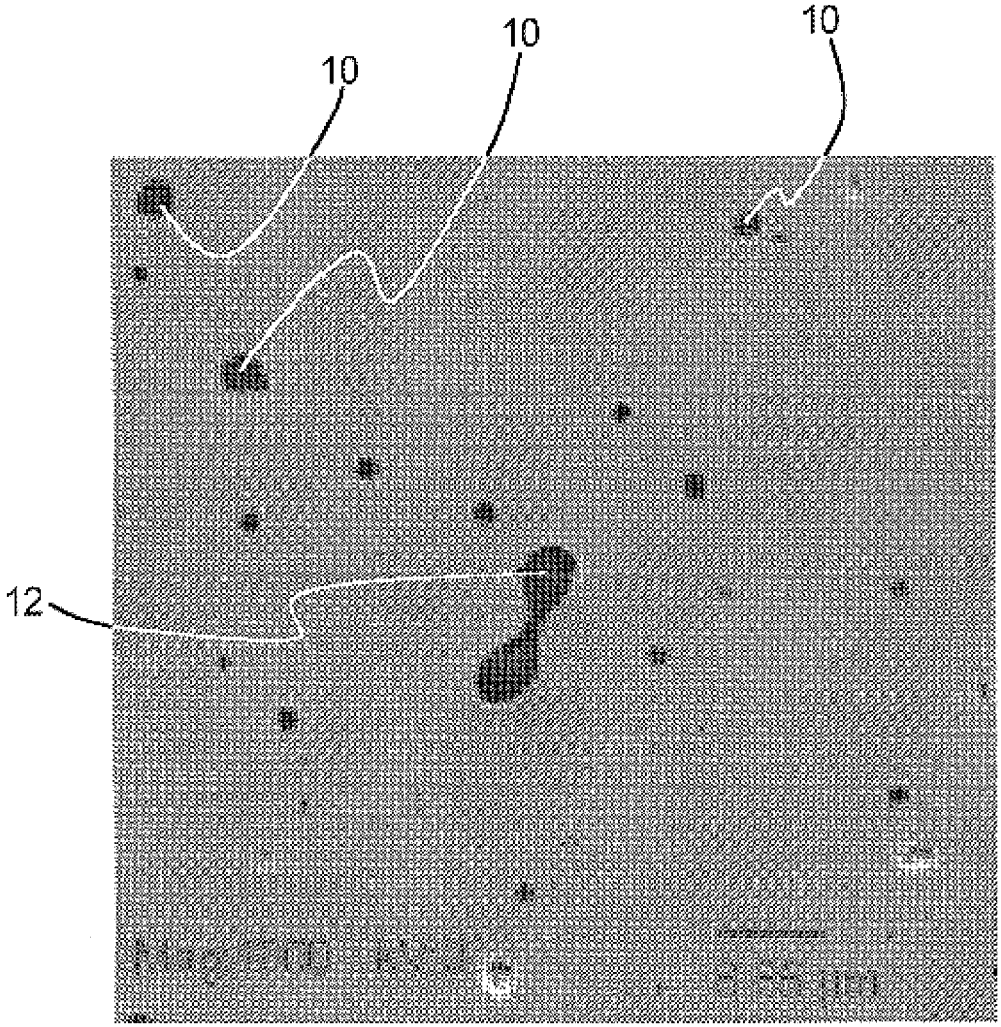
FIG. 3 is a scanning electron microscope micrograph of a molded component formed of a 17-4PH steel material with a standard silicon content.

By comparison, FIG. 3 shows a scanning electron microscope photograph of a part molded from a standard 17-4PH mixture. Large inclusions 10 are seen throughout and two large inclusions 12 in agglomeration are found in the center of the image.

Figure 4:
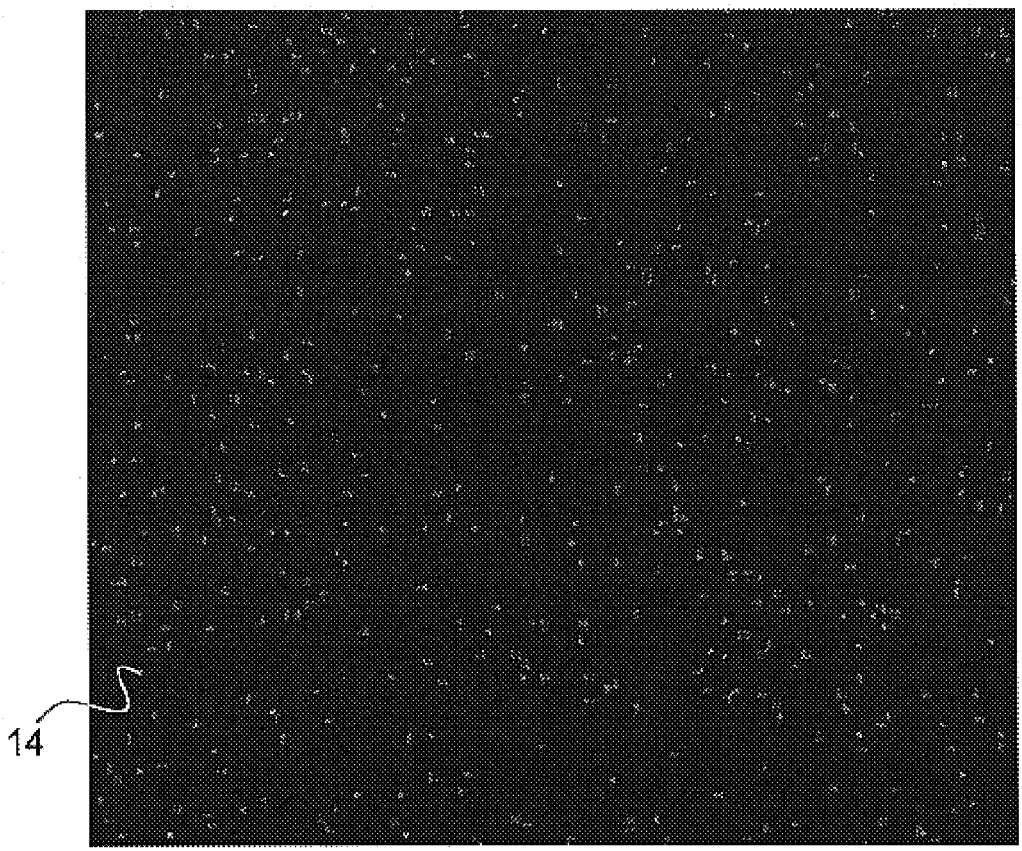
FIG. 4 is an EDS silicon map of the sample shown in FIG. 2.
Figure 5:
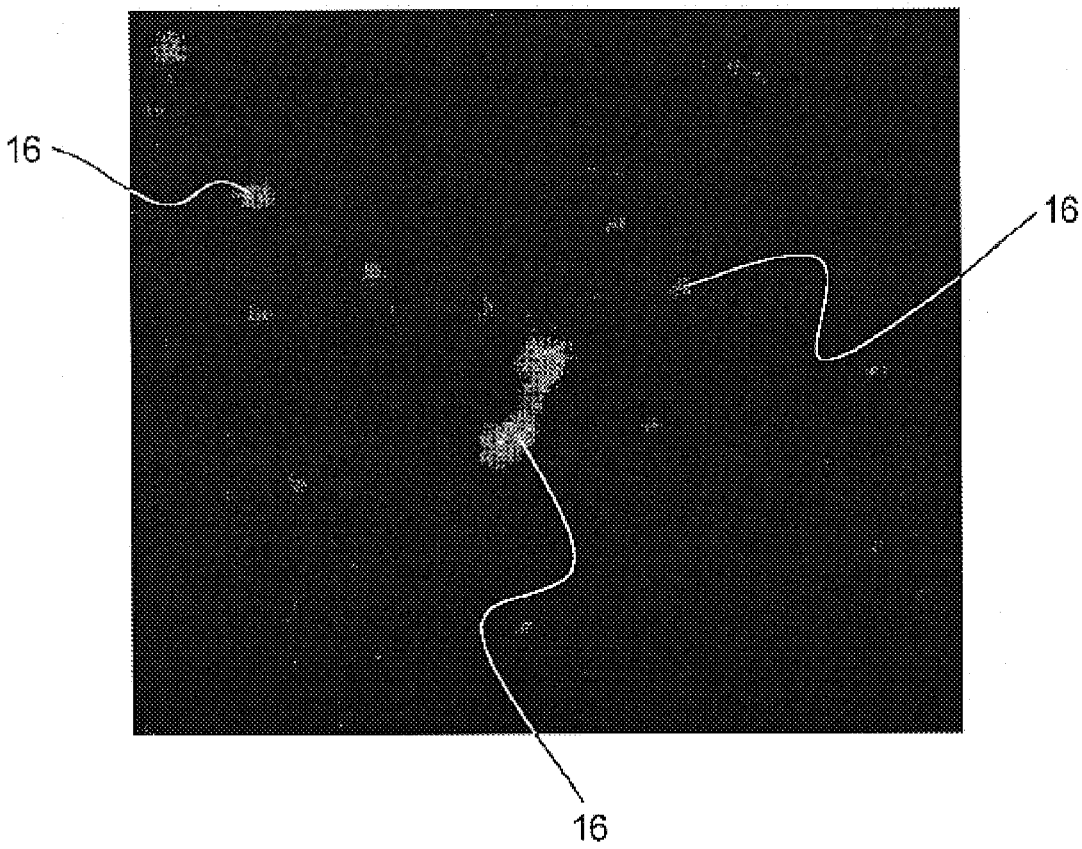
FIG. 5 is an EDS silicon map of the sample shown in FIG. 3.

FIGS. 4 and 5 contrast the silicon content of the two samples, wherein the sample of FIG. 2 according to the invention is shown in FIG. 4 has scattered small evenly dispersed silicon detections 14, whereas the sample of FIG. 3 is shown in FIG. 5 to have high concentrations of silicon 16 at the visible inclusions.

The finished part made from the powder of the present invention therefore has a greater densification and better surface finish quality. Fatigue failure initiation sites are reduced. The resulting part has an improved microstructure.

The improved characteristics of the parts produced by the present invention means that larger parts can now be made by metal injection molding. Further, structural components are now possible. One application of metal injection molding using the present invention is for the making of parts which are subject to high stresses. Highly fatigued parts, such as turbine blades of small jet engines, may be produced by the present invention.

Use of the present MIM powder is foreseen in the manufacture of aerospace components, including turbine engine vanes and blades and flow bodies. The use of the present powder to manufacture other stressed parts is also contemplated.

Although other modifications and changes may be suggested by those skilled in the art, it is the intention of the inventors to embody within the patent warranted hereon all changes and modifications as reasonably and properly come within the scope of their contribution to the art.

We claim:

1. A powder for metal injection molding, the improvement comprising the powder having a silicon content of not more than 0.1% through about 0.05%, wherein the powder is formed of a material selected from the group consisting of high nickel superalloys, titanium, and 17-4PH steel.

2. A powder as claimed in claim 1, wherein the powder has a silicon content of approximately 0.05%.

3. A powder for metal injection molding, the improvement comprising the powder having a silicon content of not more than 0.1% through about 0.05%, wherein the powder is formed of 17-4PH steel.

4. An injection molding feedstock powder, comprising:

a metal powder selected from the group consisting of high nickel superalloys, titanium, and 17-4PH steel having a silicon content of not more than 0.1% through about 0.05%, and a binder.

5. An injection molding feedstock powder, comprising:

a metal powder having a silicon content of not more than 0.1% through about 0.05%; and a binder;

wherein said metal powder is substantially of 17-4PH steel, and said binder is water base agar.

6. A molded metal part, comprising the improvement of: the molded metal part being formed by metal injection molding from a powder having a silicon content of not more than 0.1% through about 0.05%, wherein the powder is formed of a material selected from the group consisting of high nickel superalloys, titanium, and 17-4PH steel.

7. A molded metal part, comprising the improvement of:

the molded metal part being formed by metal injection molding from a powder having a silicon content of not more than 0.1% through about 0.05%;

wherein said molded metal part is molded of 17-4PH steel powder.

8. A molded metal part as claimed in claim 6, wherein said powder has a silicon content of approximately 0.05%.

9. The molded part according to claim 6, wherein the molded metal part is relatively free of silicate inclusions.

10. The molded part according to claim 6, wherein the part comprises a density of greater than approximately 99%.

* * * * *